US006209153B1

(12) United States Patent
Segien, Jr.

(10) Patent No.: US 6,209,153 B1
(45) Date of Patent: Apr. 3, 2001

(54) QUICK-INSTALL MOUNTING NUT ASSEMBLY FOR A SINGLE CONTROL KITCHEN FAUCET

(75) Inventor: Donald J. Segien, Jr., Chatsworth, CA (US)

(73) Assignee: Emhart Inc., Newark, DE (US)

( * ) Notice: Subject to any disclaimer, the term of this patent is extended or adjusted under 35 U.S.C. 154(b) by 0 days.

(21) Appl. No.: 09/570,903

(22) Filed: May 15, 2000

(51) Int. Cl.[7] ..... E03C 1/042

(52) U.S. Cl. ..... 4/695; 4/677; 137/359; 285/205; 285/340

(58) Field of Search ..... 4/675, 676, 677, 4/695; 137/359, 801; 285/205, 206, 207, 208, 310, 340; 403/322.1

(56) References Cited

U.S. PATENT DOCUMENTS

| | | | | |
|---|---|---|---|---|
| 979,652 | | 12/1910 | Church | 285/207 X |
| 1,505,279 | | 8/1924 | Mueller et al. | 4/695 X |
| 1,677,793 | | 7/1928 | Mueller et al. | 4/695 |
| 1,809,250 | * | 6/1931 | Pendleton | 285/206 X |
| 2,615,362 | * | 10/1952 | Churchman | 285/205 X |
| 3,782,417 | * | 1/1974 | Moen | 137/359 X |
| 4,281,857 | | 8/1981 | Randall | 285/34 |
| 4,433,860 | * | 2/1984 | Lindquist | 285/205 X |
| 4,856,122 | | 8/1989 | Pilolla | 4/695 |
| 5,465,749 | | 11/1995 | Sauter et al. | 137/359 |
| 5,630,628 | | 5/1997 | Mönch | 285/24 |
| 5,669,417 | | 9/1997 | Lian-Jie | 4/676 X |
| 5,715,868 | | 2/1998 | Ching et al. | 4/678 X |
| 5,741,003 | | 4/1998 | Segien, Jr. | 251/95 |
| 5,813,433 | | 9/1998 | Oswaks et al. | 137/553 |
| 5,946,746 | | 9/1999 | Bloom | 4/675 |
| 5,967,567 | * | 10/1999 | Nordstrom | 285/205 X |

FOREIGN PATENT DOCUMENTS

| | | | | |
|---|---|---|---|---|
| 4121835 | * | 1/1993 | (DE) | 4/677 |

* cited by examiner

*Primary Examiner*—Robert M. Fetsuga
(74) *Attorney, Agent, or Firm*—Edward D. Murphy; John D. Del Ponti

(57) ABSTRACT

A quick-install mounting nut assembly for connecting a shank of a faucet to a deck with the shank having an enlarged upper portion disposed above the deck and a smaller diameter lower portion extending through an opening of the deck. A strap of the assembly is loosely disposed on the lower portion of the shank to be axially raised thereon. The strap has a pair of ears formed thereon with apertures therein. A pair of clips are connected to the ears of the strap and each has an aperture therein aligned with the apertures of the ears of the strap. Each of the clips has a clamping portion biased downwardly into engagement with the lower portion of the shank. A pair of fastener members are separately disposed through the apertures of the strap and the clips and are in threaded engagement with the clips. A pair of nuts are separately disposed upon the ears of the strap to be threadedly engaged by the fastener members. The strap is axially shifted upwardly upon the shank to cause the upper end of each of the fastener members to contact the underside of the deck whereby the fastener members are tightened upwardly upon the underside of the deck to force the clamping portions of the clip downwardly to bite and come into clamping engagement with the shank and to affix the shank in assembled position with the deck.

8 Claims, 6 Drawing Sheets

QUICK-INSTALL MOUNTING NUT ASSEMBLY FOR A SINGLE CONTROL KITCHEN FAUCET

BACKGROUND OF THE INVENTION

This invention relates to a quick-install mounting nut assembly for a single control kitchen faucet in which the connection of the faucet shank to the deck may be completed from below the deck without the use of any tools. Because the space below the deck is usually very crowded and hard to get at, making the connection is often troublesome and time consuming. Accordingly, when tools must be used to connect the faucet shank, the result is sometimes a poor or faulty connection.

SUMMARY OF THE INVENTION

It is an object of the present invention to provide an improved quick-install mounting nut assembly for a single control kitchen faucet that may be completed below the deck without the use of tools, which connection is easy to make, which assembly is economical to produce and highly reliable in operation in that the faucet remains connected to the deck, but can be readily disconnected therefrom.

It is another object of the present invention to provide a quick-install mounting nut assembly that is made from below the deck; the assembly components may be self contained as a unit; and the assembly may be connected or disconnected to the faucet shank quickly and easily, with or without tools.

It is another object of the present invention to provide a quick-install mounting nut assembly that is operated manually, with or without tools, to both connect and disconnect the faucet shank to the deck; which assembly, in clamping position, utilizes clamping members to exert a clamping force or, when the assembly is being unclamped, the clamping members are free to flex in a loosened unclamped position that permits disassembly of the previously assembled components.

It is still another object of the present invention to provide a quick-install mounting nut assembly that connects the shank of the faucet to the deck in a secure and balanced manner and, whenever desired, is easy to disassemble; which is a self contained unit that utilizes a pair of fasteners, such as thumbscrews, that are manually tightened to secure the shank of the faucet to the deck from the underside of the deck.

Other objects, features and advantages of the present invention will become more fully apparent from the following detailed description of the invention, the appended claims and the accompanying drawings.

BRIEF DESCRIPTION OF THE DRAWINGS In the accompanying drawings.

DETAILED DESCRIPTION OF THE PREFERRED EMBODIMENT

Figure 1:
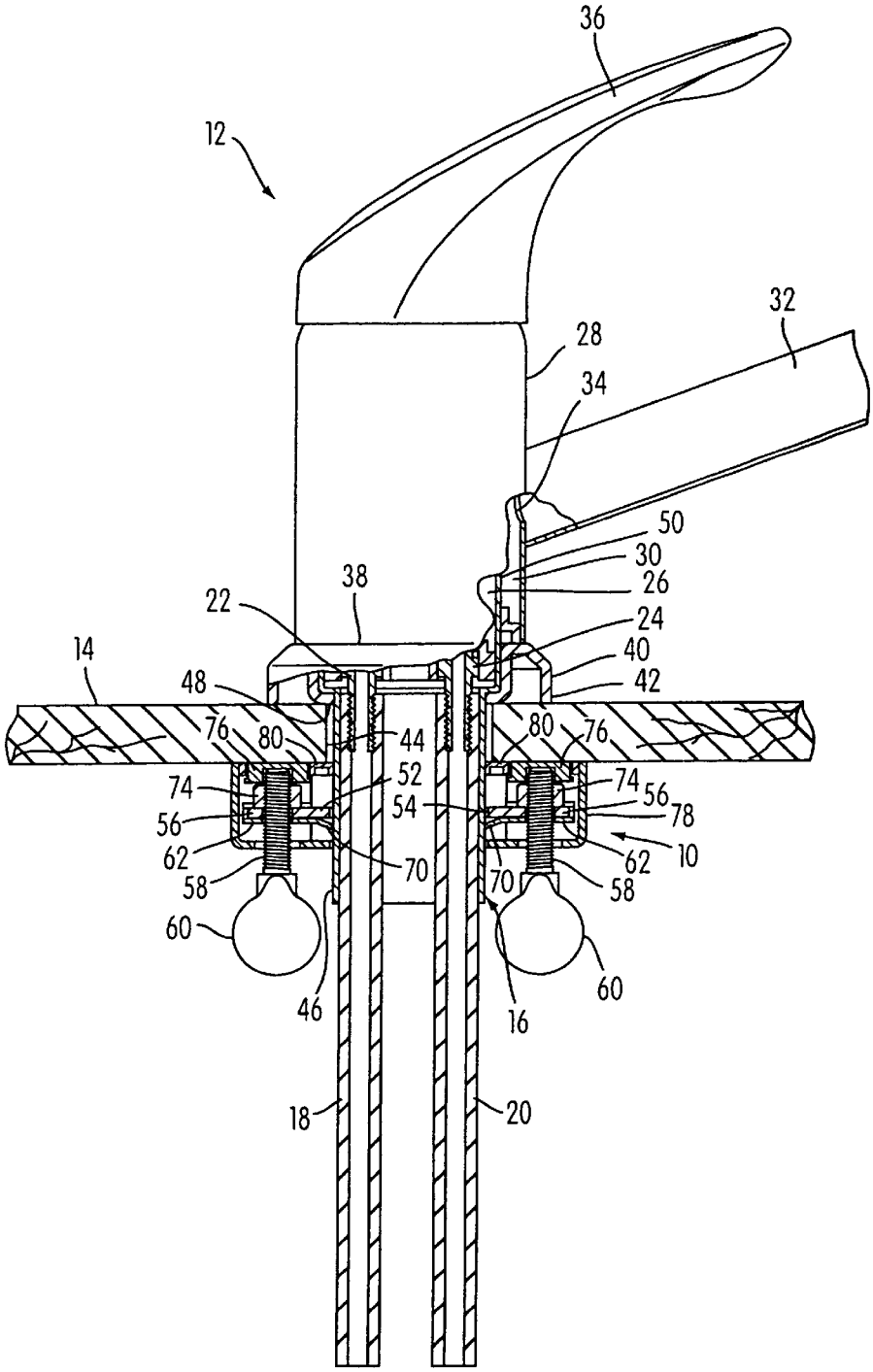
FIG. 1 is a side elevational view, partly in section, of the quick-install nut assembly of the present invention in clamped position.

With reference to the accompanying drawings, the quick-install mounting nut assembly 10 of the present invention is illustrated with a single control kitchen faucet 12, shown only in FIG. 1, but it is understood that the principles of the present invention may also be applied to any other type of faucet, such as two handle faucets or the like. In the present instance, the faucet 12 is connected to a deck 14 by a shank 16, through which passes a hot water line 18 and a cold water line 20 from under the deck 14 to separately connect at coupling 22 and 24, respectively, into a mixing valve 26 mounted in the shank 16. The faucet 12 has a housing 28 disposed about the shank 16 and between which is formed an annular chamber 30 which receives the discharged mixed water from the valve 26 to be delivered to a spout 32 through an opening 34 for discharge from the faucet in a conventional manner. A single handle 36 is shiftably secured to the housing 28 and operationally connected to control the mixing valve 26 and thereby control the discharge (not shown) from the spout 32. The housing 28 nests upon the upper end 38 of a trim plate 40 which has its lower outer end 42 rest upon the deck 14 outwardly of a circular opening 44 formed therein and through which the reduced diameter lower portion 46 of the shank extends. The trim plate 40 has a horizontally extending inner flange 48 that extends above and into the opening 44 of the deck 14 and is contacted by the larger diameter upper portion 50 of the shank 16 that nests thereon. However, the upper portion 50 of the shank 16 has a larger diameter than the opening 44 of the deck 14 so that, with or without, the inner flange 48 it will always remain above the deck 14.

The quick-install mounting nut assembly 10 clamps the shank 16 to the deck 14 as described in more detail hereinafter and as illustrated in the drawings herein, but before describing its operation, the individual components shown in FIG. 2 will be described. Accordingly, the assembly 10 has a strap 52 having a central opening 54 and a pair of ears 56 formed on opposite sides thereof. Each of the ears 56 has an aperture 57 therein of slightly larger diameter than the diameter of the threaded section 58 of a fastening member such as a thumbscrew 60 that will extend therethrough. A clip 62 is loosely connected to the underside of each of the ears 56 by means of four turned over fingers 64. Each clip 62 has an opening 66 about the same diameter as that of the threaded section 58 of the thumbscrews 60 so that each of the clips 62 will be connected to respond to the movement of the thumbscrews 60 for purposes to be described in greater detail hereinafter. Two vertical legs 68 are formed inwardly of adjacent fingers 64 and rise upwardly from opposite sides of each other above the opening 66 so that, once the clip 62 is connected to the ear 56, the width of each of the legs 68 will extend a greater distance than that of the aperture 57 of the ear 56. Each of the clips 62 will be connected to respond to the movement of the thumbscrews 60 for purposes to be described in greater detail hereinafter. Each of the clips 62 has a flexible forward section 70 that is biased downwardly and has a central "V" notch 72 formed therein. With the clip 62 connected to the ear 56 the forward section 70 will extend into and be biased downwardly below the area of the central opening 54 of the strap 52. A nut 74 will be disposed on the top of the ear 56 and loosely non-turnably held thereon by the legs 68 so as to threadedly receive the threaded section 58 of the thumbscrew 60. A pad 76 will be connected upon the top of the threaded section 58 of the thumbscrew 60. The assembly 10 including the strap 52 to which the clip 62 and nut 74 are disposed as a unit in a casing 78 to which a cover 80 is added. Thereafter the thumbscrews 60 are threadedly connected through the clips 62, the strap 52 and the nuts 74 and the pads 76 are connected to the upper ends thereof. It is understood that the casing 78 and the cover 80 each have a central opening similar to that of the strap 52. Also, the casing 78 has apertures similar to that of the strap 52. Also, the casing 78 has apertures similar to the apertures 57 of the ears 56, while the cover 80 has apertures sized to have the pads 76 extend therethrough.

Figure 2:
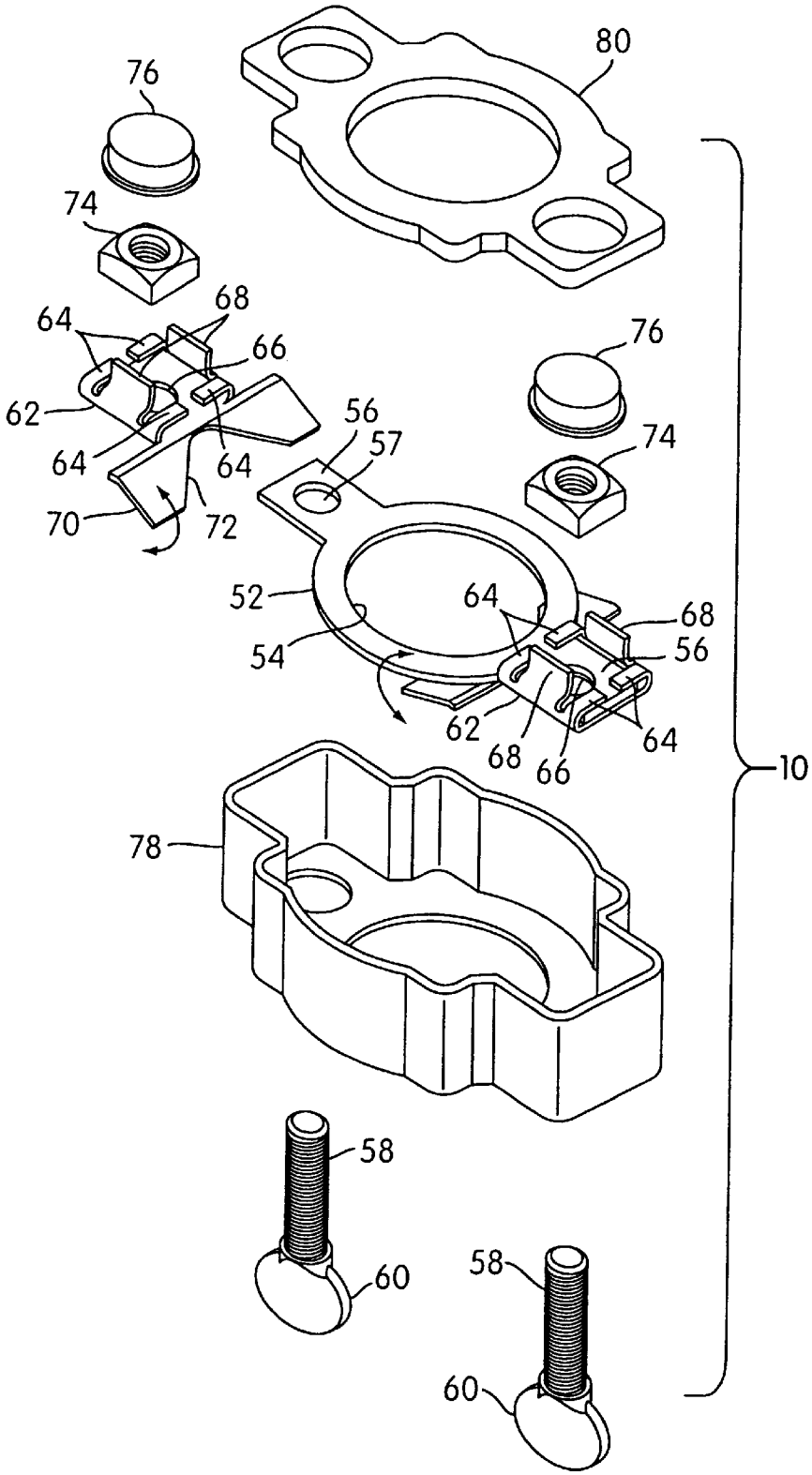
FIG. 2 is an exploded perspective view of the quick-install nut assembly shown in FIG. 1, absent the deck, the shank and the rest of the faucet.
Figure 3:
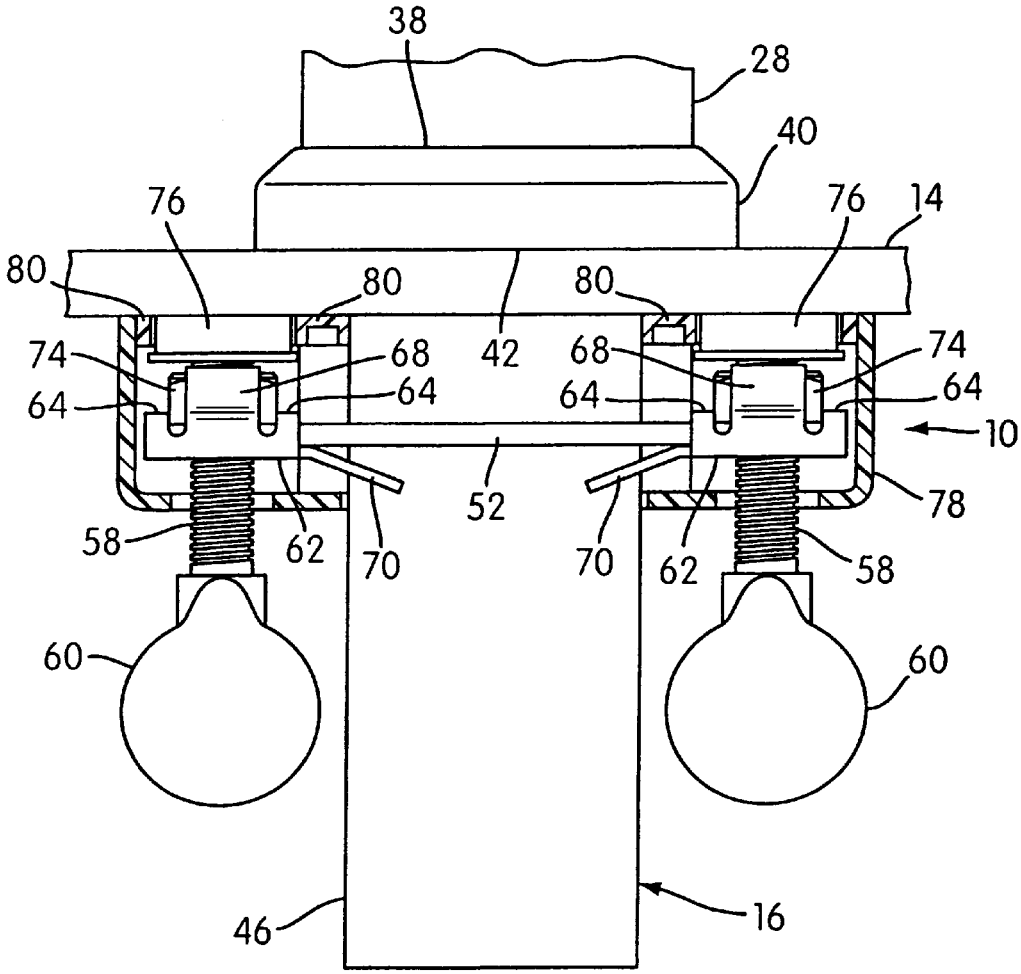
FIG. 3 is a fragmented enlarged side elevational view, partly in section, showing the quick-install nut assembly of the present invention shown in FIG. 1.
Figure 4:
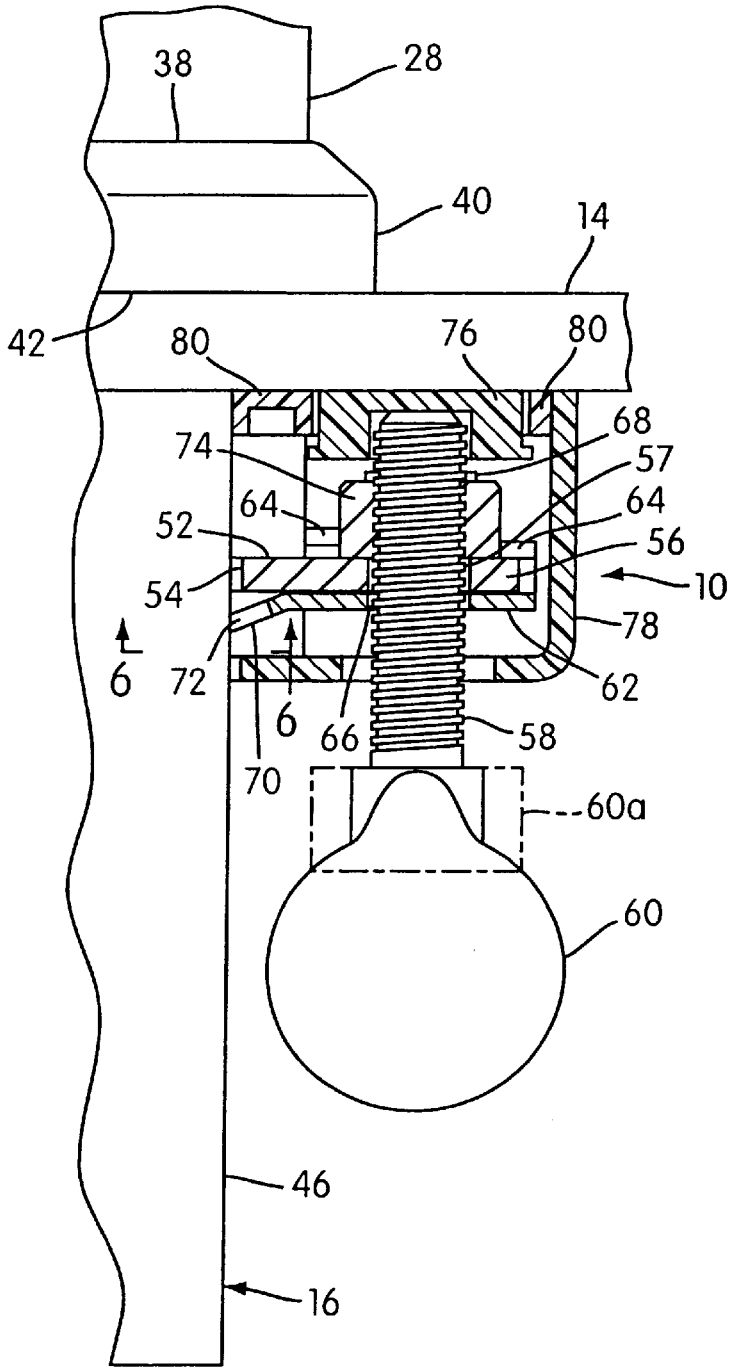
FIG. 4 is a greatly enlarged fragmented right side view, partly in section, of the components of the quick-install nut assembly of the present invention shown in FIG. 3.
Figure 5:
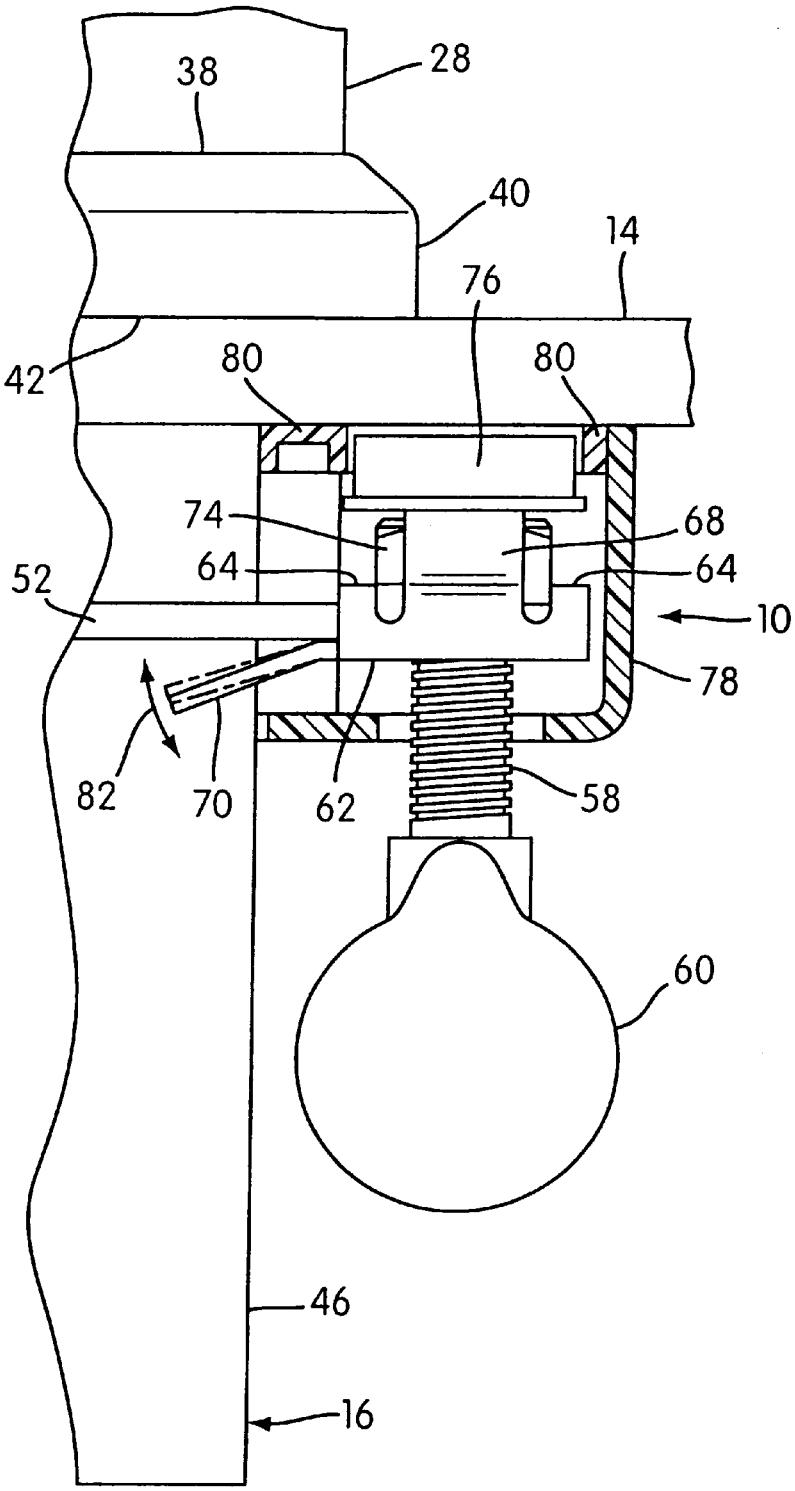
FIG. 5 is a greatly enlarged fragmented right side elevational view, partly in section, similar to FIG. 4 except that the assembly is in unclamped position, with the clip of the quick-install nut assembly is loose and free to flex.
Figure 6:
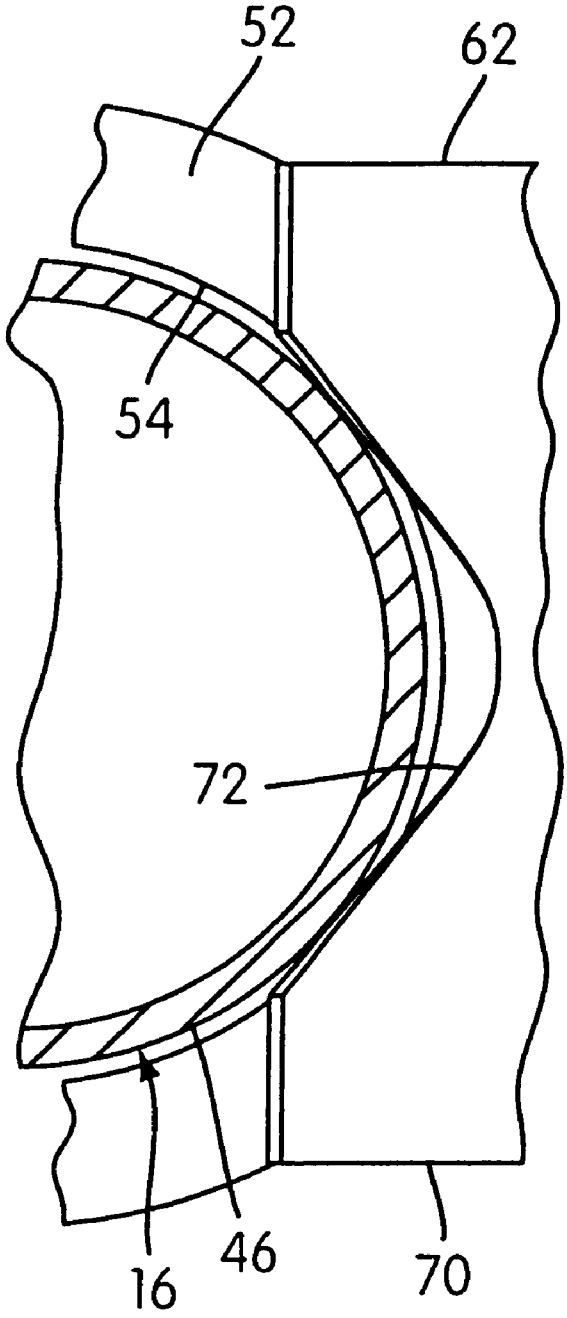
FIG. 6 is a view taken along line 6—6 of FIG. 4.

Turning now to FIGS. 3, 4 and 5, it will be understood that the quick-install mounting nut assembly 10 shown and described in FIG. 2 will be pre-assembled as a unit and the shank 16 will have had its lower portion 46 disposed through the opening 44 of the deck 14 so that the upper portion 50 of the shank 16 will be sitting on the upper side of the deck 14. Thereafter, the assembly 10 will be axially raised on the lower portion 46 of the shank 16 until the pads 76 contact the underside of the deck 14. This causes the "V" notch 72 of the flexible forward section 70 of the clip 62 to slide upwardly along the lower portion 46 of the shank 16 as the assembly 10 is raised axially upwardly to bring the pads 76 into contact the underside of the deck 14. To secure the connection, the thumbscrews 60 are now turned to further force the pads 76 upwardly against the underside of the deck 14. The force is distributed along the greater area of the pads rather than merely making a point contact as might have occurred without the pads 76 at the upper end of the thumbscrews 60. The "V" notches 72 are now forced to bite down and into the lower portion of the shank 16 at least two points thereof since the shank is made of a softer material, such as brass, while the clips 62 may be made of steel. This is illustrated in FIG. 6. Applying a greater force upwardly, via tightening of the thumbscrews 60, to the underside of the deck 14, produces a greater force downwardly upon the lower portion 46 of the shank 16, via a "V" notch 72 of the flexible forward section 70 of the clips 62 to solidly seat the shank 16 against the deck 14 and thereafter permit the connection of all of the remaining faucet components to complete the faucet 12 connection to the deck 14, as is shown in FIG. 1. Thus, the quick-install mounting nut assembly 10 can be manually operated without the use of tools to complete the below the deck connection of the shank 16 to the deck 14. Of course, if desired, tools can be used on either the thumbscrew 60 shown in solid line representation in the drawings or as shown only in FIG. 4 the dotted line representation of the thumbscrew 60 can be replaced by any other fastening member, such as a hex-head machine screw 60*a* which would be used in place of the thumbscrew 60.

Whenever it is required, the faucet 12 may be disassembled by disassembly of the shank 16 in which the faucet 12 components can be disconnected in the conventional manner and the shank 16 can be disassembled by simply reversing the procedure and, instead of tightening the thumbscrew 60, it will be loosened to lower the pad from its contact from the underside of the deck 14, as shown in FIG. 5. This removes the downward force between the clips 62 and the lower portion 46 of the shank 16 and permits the loose movement of the flexible forward section 70 of the clips 62, as indicated by the double headed arrow 82 and the solid and dotted line representation of the flexible forward section 70. The threaded connection between the threaded section 58 of the thumbscrew 60 and the opening 66 of the clip 62 will keep the clip against the underside of the strap 52. Thereafter, either or both the assembly 10 and/or the shank 16 can be removed or otherwise disassembled to a greater extent.

It will also be appreciated that the above-described invention may be embodied in other specific forms without departing from the spirit or essential characteristics thereof. The present embodiments are, therefore, to be considered in all aspects as illustrative and not restrictive, the scope of the invention being indicated by the appended claims rather than by the foregoing description, and all changes which come within the meaning and range of equivalency are, therefore, intended to be embraced therein.

What is claimed is:

1. A quick-install mounting nut assembly for connecting a faucet shank to a deck, with the shank having an enlarged upper portion disposed above the deck and a smaller diameter lower portion extending through an opening of the deck, the mounting nut assembly comprising:

a. a strap loosely disposed on the lower portion of the shank to be axially shiftable thereon, and having at least one ear formed thereon with an aperture therein;

b. a clip connected to the strap and having an aperture thereon aligned with the aperture of the ear of the strap;

c. the clip having a clamping portion biased downwardly into engagement with the lower portion of the shank;

d. a fastener member disposed through the apertures of the strap and the clip, and in threaded engagement with the clip;

e. a nut disposed upon the strap and threadedly engaging the fastener member; and f. the strap axially shiftable upwardly upon the shank to cause the upper end of the fastener member to contact the underside of the deck whereby the fastener member is tightened upwardly into the deck to force the clamping portion of the clip downwardly into clamping engagement with the shank to affix the shank in assembled position to the deck.

2. The combination claimed in claim 1 wherein:

a. the clip is disposed on the underside of the strap;

b. the nut is disposed on the upper side of the strap; and c. the clamping portion of the clip is a spring member.

3. The combination claimed in claim 2 wherein:

a. a pad is disposed over the upper end of the fastener member to distribute the force over a wider area of the underside of the deck.

4. The combination claimed in claim 3 wherein:

a. a fastener member is loosened downwardly to remove contact of the pad with the deck and to unclamp the clamping portion of the clip from the shank to permit the shank to be disassembled by removal from the deck.

5. The combination claimed in claim 4 wherein:

a. a housing is disposed about the mounting nut assembly;

b. the housing has an aperture aligned with the strap and the clip apertures whereby the fastener means extends outwardly of the housing.

6. The combination claimed in claim 5 wherein:

a. the strap has a pair of ears formed on opposite sides of the shank with apertures formed therein; and b. the clip, the nut and the fastener member of the pad each are in pairs separately associated with one of the ears of the strap.

7. The combination claimed in claim 6 wherein:

a. the fastener members define thumbscrews.

8. The combination claimed in claim 6 wherein:

a. the fastener members define machine screws.

* * * * *